US006328022B1

(12) United States Patent
Kolb

(10) Patent No.: US 6,328,022 B1
(45) Date of Patent: Dec. 11, 2001

(54) METHOD FOR TESTING A FUEL TANK IN A MOTOR VEHICLE FOR TIGHTNESS

(75) Inventor: Hartmut Kolb, Ludwigsburg (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/348,171

(22) Filed: Jul. 7, 1999

(30) Foreign Application Priority Data

Jul. 7, 1998 (DE) ..... 198 30 234

(51) Int. Cl.[7] ..... F02M 33/02
(52) U.S. Cl. ..... 123/520; 123/198 D
(58) Field of Search ..... 123/520, 516, 123/518, 521, 198 D

(56) References Cited

U.S. PATENT DOCUMENTS

| | | | | |
|---|---|---|---|---|
| 5,353,771 | * | 10/1994 | Blumenstock et al. | 123/520 |
| 5,460,141 | * | 10/1995 | Denz et al. | 123/520 |
| 5,499,613 | * | 3/1996 | Bayerle et al. | 123/518 |
| 5,572,981 | * | 11/1996 | Pfleger et al. | 123/698 |
| 5,678,523 | | 10/1997 | Hashimoto et al. | 123/520 |
| 5,699,775 | * | 12/1997 | Azuma | 123/520 |

FOREIGN PATENT DOCUMENTS

| | | |
|---|---|---|
| 196 36 713 | 9/1997 | (DE) . |
| 197 48 862 | 6/1998 | (DE) . |

* cited by examiner

*Primary Examiner*—Henry C. Yuen
*Assistant Examiner*—Mahmoud W. Gimie
(74) *Attorney, Agent, or Firm*—Crowell & Moring LLP

(57) ABSTRACT

In a method for testing the tightness of a fuel tank in a motor vehicle, a container that absorbs fuel vapors and is connected by a vent line with a fuel tank and by a scavenging line with an intake manifold of the internal combustion engine of the motor vehicle is provided. The container has a vent line that is connected to the atmosphere, the line being closable by a shutoff valve. In addition, a pressure sensor that detects the system pressure in the fuel tank and a scavenging valve located in the scavenging line, which is opened to feed the fuel vapors stored in container and to develop a vacuum in the tank ventilation system, is provided. The fuel tank is kept at a specific pressure at least approximately during the entire operation of the vehicle and, after a preliminary period that corresponds at least approximately to the time interval during which compensatory processes such as condensation or outgassing of the fuel run to completion, the tightness test is performed at any point in time and in any operating state of the vehicle with the fuel tank sealed pressure-tight.

6 Claims, 2 Drawing Sheets

METHOD FOR TESTING A FUEL TANK IN A MOTOR VEHICLE FOR TIGHTNESS

BACKGROUND AND SUMMARY OF THE INVENTION

This application claims the priority of German Application No. 198 30 234.7, filed Jul. 7, 1998, the disclosure of which is expressly incorporated by reference herein.

The invention relates to a method for testing the tightness of a fuel tank in a motor vehicle, said tank having a ventilation system.

To diagnose leaks in a motor vehicle fuel tank, the tank is initially pressurized and then sealed pressure-tight. Next, the pressure in the tank is monitored for a certain time period. If the pressure does not change beyond a certain degree, then the system is assumed to be sealed tight. Such diagnostic measures are known for example from German Patent documents DE 44 27 688 A1, DE 4303 997 A1, and DE 196 36 713 A1.

In known methods, leaks usually can be detected only when they are 1 mm or more in diameter. Smaller leaks present problems in reliably detecting the leaks. Under existing legislation, in the United States for example, where leaks 0.5 mm in diameter must be detected, diagnostic procedures must be improved accordingly. In known methods, a pressure curve is recorded during diagnosis. However, a problem arises in that compensatory processes operate after the interior tank pressure has been lowered which cause the pressure to rise even in a tank that is absolutely tight. Such compensatory processes include outgassing or condensation of the fuel. The rise in pressure caused by such compensatory processes masks pressure changes produced by very small leaks and thus prevents a reliable diagnosis. When the compensatory processes (lasting approximately 10 to 15 minutes) are complete, a uniform state is established in which the effects of leaks can be distinguished more clearly. However, in the case of "on-board" tests, no time is available to wait for this state to become established.

In known methods, leak diagnosis can be performed only when the vehicle is at rest or operating in neutral and requires several minutes, for example when stopped at a traffic light. Other boundary conditions must be fulfilled as well. This operating state of the vehicle however is also regularly used to purge the container that absorbs fuel vapors. Such a container usually contains activated charcoal. This container must be flushed regularly and as often as possible, for which purpose a shutoff valve is opened and the flushing air is supplied to the internal combustion engine through a vent line and scavenging valve, which is also open. In this fashion, the activated charcoal filter is purged once again. If a tightness diagnosis is performed in these operating states, there is an inadequate amount of time to purge the activated charcoal container. Since incorrect measurements frequently occur with known diagnostic methods, the test must be repeated often until reliable values are obtained. This means that valuable time is wasted in purging the activated charcoal container with known methods, so that the container must be correspondingly generously dimensioned for safety reasons so that it remains operable at all times.

Therefore, the goal of the present invention is to improve the accuracy of the method mentioned at the outset using error diagnosis, with the test being performed as much as possible without interfering with normal driving, especially with purging of the activated charcoal container.

According to the invention, this goal is achieved by a method for testing a fuel tank in a motor vehicle for tightness, is with a container that absorbs fuel vapors, said container being connected through a vent line with a fuel tank and/or scavenging line with an intake manifold on the engine of the motor vehicle, and which has a vent line connected with the atmosphere, said line being closable by a shutoff valve, with a pressure sensor that measures system pressure in the fuel tank, and with a scavenging valve located in the scavenging line, said valve being opened to admit the fuel vapors stored in the container and to develop a vacuum in the tank venting system. The fuel tank is kept at least approximately during the entire operation of the motor vehicle at a specific pressure. After a preliminary period which at least approximately corresponds to the amount of time in which compensatory processes such as condensation or outgassing of fuel run to completion, a tightness test is performed at any point in time and in any operating state of the vehicle with the fuel tank sealed.

One of the important features of the invention is that the fuel tank is kept under a specific pressure for nearly the entire period of operation. This means that after a certain preliminary period during which the compensatory processes take place, stable operation prevails nearly throughout the entire operating time of the motor vehicle and a test can be performed at any opportunity, without being distorted by compensatory processes. One important advantage of the invention consists in the fact that one is no longer limited, as in the prior art, to performing the test with the vehicle at rest or in neutral, at which time the necessary purging of the activated charcoal container can also be performed. Rather, the assessing method according to the invention can also be performed with the vehicle in motion, for example with a partial load.

Advantageously, the fuel tank is operated under a slight vacuum since this can be created in a very simple fashion, for example by a suitable setting of the shutoff valve and designing the latter as a regulating valve.

Another advantage of operating the fuel tank under constant vacuum is that it further refines the testing of the fuel tank for tightness. This is because after the fuel tank has been tested for tightness, the fuel tank can be operated for a short time at zero pressure or with overpressure, with any possible outgassing or condensation being measured and subtracted from the values determined during the previous test.

The fact that the fuel tank is operated under a constant vacuum means that the compensatory processes will run to A completion after a certain time. If now, according to the invention, the fuel tank is nevertheless pressurized for a short time or if it is kept at least at zero pressure, it is possible to check in this fashion whether there was any outgassing or condensation during the previous measurement.

This would be the case, for example, if the fuel was relatively warm, since then the highly volatile components of the fuel could outgas. With the expansion according to the invention, the measurement accuracy can be improved even further in this manner.

In an additional improvement on the invention, provision can also be made to take the tank volume and the fullness of the tank into account during the test.

Other objects, advantages and novel features of the present invention will become apparent from the following detailed description of the invention when considered in conjunction with the accompanying drawings.

DETAILED DESCRIPTION OF THE DRAWINGS

Figure 1:
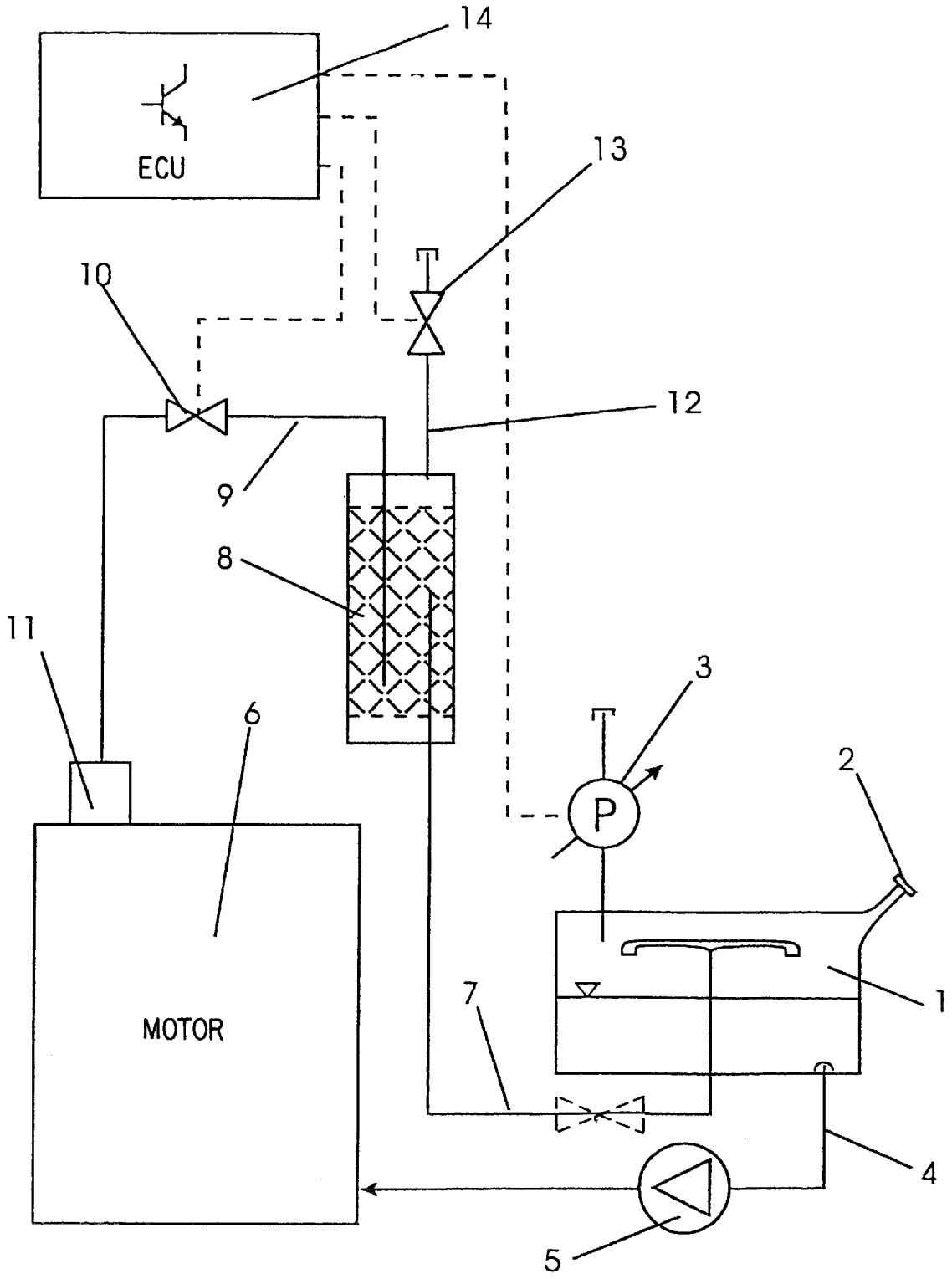
FIG. 1 is a schematic diagram of an internal combustion engine with a tank venting system and a device for checking the functioning ability of the tank ventilating system according to the invention.

Both the fuel tank and the tank ventilation system for a motor vehicle are shown in a highly simplified manner in FIG. 1. A fuel container or tank 1 is provided with a filling neck that can be closed hermetically by a cap 2. Tank 1 is also provided with a tank pressure sensor 3 by which the pressure in the fuel tank can be measured. A fuel line 4 runs from tank 1 and is coupled with a fuel pump 5 connecting it to a motor 6. The tank 1 is also provided with a pressurizing and vent line 7 in which a container, namely an activated charcoal container 8, is located. The container 8 adsorbs the fuel vapors emerging from the tank. A scavenging line 9 runs from the activated charcoal container 8 to an engine intake manifold 11. A scavenging valve 10 is located in the line 9. The activated charcoal container 8 can also be connected with the atmosphere by a vent line 12 in which there is arranged a shutoff valve 13. The shutoff valve 13 is designed as a throttle or regulating valve that can be regulated. Shutoff valve 13, scavenging valve 10, and tank pressure sensor 3 are each connected by control lines with an engine control device 14.

In order to keep the adsorption capacity of the activated charcoal container 8 as high as possible in all operating cases, an effort is made as soon as possible after the engine has been started to draw flushing air via scavenging valve 10 (with shutoff valve 13 appropriately opened) through the activated charcoal container 8 and thus to purge the container 8. As soon as this process has begun, the shutoff valve 13 is energized so that it acts as a variable throttle or as a regulating valve to set a constant vacuum in tank 1 that is monitored by the tank pressure sensor 3. In a manner not shown in greater detail, monitoring is performed by the control lines and the engine control device 14 in such fashion that the specified vacuum is constantly maintained.

The test method according the invention to determine tightness proceeds as follows:

1. Coarse Leak Detection:

When there is a large hole in the fuel tank 1, for example if the tank 2 has not been properly closed, the pressure regulation system cannot set the desired vacuum. This is already apparent shortly after starting, and can be displayed to warn the driver.

2. Minor Leak Detection:

If the constant vacuum has been present for at least several minutes in tank 1, the actual test can proceed. At the beginning of the test, tank 1 is closed off; then the pressure curve is monitored. The pressure rise is directly proportional to the existing leak. If it remains within specific limits for a specified period of time, acceptable leaks can be assumed to exist.

Figure 2:
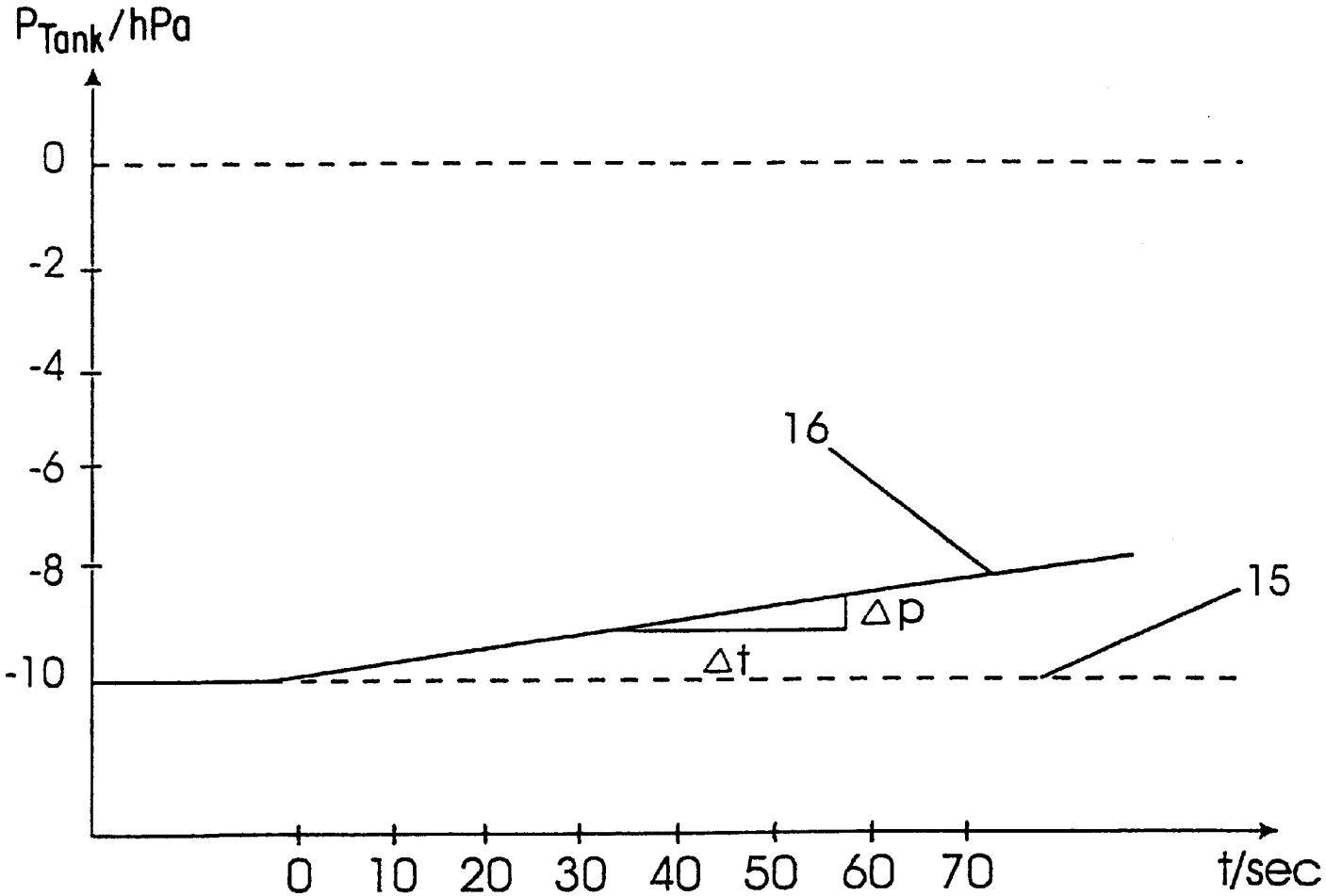
FIG. 2 is a diagram showing a pressure curve for a testing method according to the invention.

The pressure curve during the test procedures can be seen in FIG. 2. The pressure in the fuel tank 1 is plotted on the ordinate and the time is plotted on the abscissa. In the ideal state, when there is no leak, a horizontal line like dashed line 15 will be obtained, in other words, a constant pressure will be maintained. However, if there is a rising line like line 16 corresponding to $\Delta P/\Delta T$, it is evident that there is a leak in the fuel tank 1.

However, in order to be sure that no outgassing has taken place during the test, the tank can be vented after performing a minor leak test, in other words relieved of any pressure, and then sealed off pressure-tight once again. If the pressure then rises, it characterizes the degree of existing outgassing. This outgassing component can then be subtracted from the minor leak increase, giving the net leakage.

The pressure rise in the fuel tank 1 during the test however does not depend upon how full the tank is. With the tank nearly empty, a different pressure gradient is obtained than in a tank that is mostly full and so contains only a small gas volume. In the latter case, the pressure rise will be steeper because the gas volume is smaller. Even more precise leak detection can be achieved by a correlation or consideration of the fullness of the tank. Since in most modern vehicles the level of the tank is accessible for engine control and therefore for the engine control device 14, such a correlation can be achieved without any particular additional costs.

The test however does not necessarily have to be performed on a vehicle at rest, but can be performed even at high load and high speed. Performance of the test in this driving state, in which the activated charcoal container 8 cannot be purged, is therefore especially attractive. Since the test takes only about one to two minutes, the brief disconnection of the fuel tank does not interfere with driving.

It is possible for example to set −10 hPa as the permanent vacuum during driving.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for testing a fuel tank for tightness, the fuel tank being in a motor vehicle having a container that absorbs fuel vapors, the container being coupled through at least one of a vent line with the fuel tank and a scavenging line with an intake manifold of an engine of the motor vehicle, said vent line coupling with the atmosphere and being closable via a shutoff valve, the motor vehicle further including a pressure sensor which measures system pressure in the fuel tank and a scavenging valve arranged in the scavenging line, said scavenging valve being opened to admit fuel vapors stored in the container and to develop a vacuum, the method comprising the acts of:

during substantially an entire operation of the motor vehicle, maintaining the fuel tank at least approximately at a specific pressure;

after a preliminary time period approximately corresponding to an amount of time in which compensatory processes of fuel in the fuel tank are completed, performing a tightness test of the fuel tank at any point in time and in any operating state of the vehicle with the fuel tank being sealed after the fuel tank has been tested for tightness, operating the fuel tank for a short time period under zero pressure or under overpressure, with any outgassing or condensation being measured and with values determined therefrom being subtracted from values recorded during the previous test.

2. The method according to claim 1, wherein the fuel tank is operated under a vacuum.

3. The method according to claim 2, wherein the shut-off valve is a regulating valve such that a vacuum can always prevail in the fuel tank.

4. The method according to claim 3, further comprising the act of factoring into account a tank volume and fuel level in the fuel tank during the previous test.

5. The method according to claim 2, further comprising the act of factoring into account a tank volume and fuel level in the fuel tank during the previous test.

6. The method according to claim 1, further comprising the act of factoring into account a tank volume and fuel level in the fuel tank during the previous test.

* * * * *